US007412030B1

(12) United States Patent
O'Hara

(10) Patent No.: US 7,412,030 B1
(45) Date of Patent: Aug. 12, 2008

(54) APPARATUS EMPLOYING CONICALLY PARALLEL BEAM OF X-RAYS

(76) Inventor: David O'Hara, P.O. Box 12212, Tallahassee, FL (US) 32317

( * ) Notice: Subject to any disclaimer, the term of this patent is extended or adjusted under 35 U.S.C. 154(b) by 0 days.

(21) Appl. No.: 11/681,980

(22) Filed: Mar. 5, 2007

Related U.S. Application Data

(63) Continuation-in-part of application No. 11/279,676, filed on Apr. 13, 2006, now abandoned.

(60) Provisional application No. 60/779,303, filed on Mar. 3, 2006.

(51) Int. Cl.
*G21K 1/06* (2006.01)

(52) U.S. Cl. ..... 378/85; 378/84; 378/145

(58) Field of Classification Search ..... 378/45–49, 378/84, 85, 145; 359/574
See application file for complete search history.

(56) References Cited

U.S. PATENT DOCUMENTS 6,278,764 B1 * 8/2001 Barbee et al. ..... 378/84

* cited by examiner

*Primary Examiner*—Jurie Yun
(74) *Attorney, Agent, or Firm*—Allen, Dyer, Doppelt, Milbrath & Gilchrist, P.A.

(57) ABSTRACT

An apparatus directing x-rays along a predetermined axis includes an x-ray optic having one or more nested x-ray reflector rings positioned relative to a source generating broad spectrum x-rays so that generated x-rays moving away from the predetermined axis are collected by the reflector incident at or close to a Bragg angle to thereby reflect the collected x-rays into a conically parallel beam. A first diffractor is positioned relative to the x-ray optic to receive incident thereon the conically parallel beam, the first diffractor selected from a truncated cone and a cylinder and diffracting the conically parallel beam toward the predetermined axis. A second diffractor is positioned relative to the first diffractor and having a geometry effective to receive incident thereon and redirect the conically parallel beam along the predetermined axis as a collimated beam of substantially parallel x-rays.

6 Claims, 5 Drawing Sheets

APPARATUS EMPLOYING CONICALLY PARALLEL BEAM OF X-RAYS

RELATED APPLICATION

This application is a continuation-in-part of and claims priority from nonprovisional application Ser. No. 11/279,676, which was filed on Apr. 13, 2006 now abandoned, and also from provisional application Ser. No. 60/779,303, which was filed on Mar. 3, 2006, both of which applications are incorporated herein by reference in their entirety.

FIELD OF THE INVENTION

This invention relates to an X-ray apparatus and, more specifically, to an X-ray apparatus employing a conically parallel beam of X-rays

BACKGROUND OF THE INVENTION

Pollution control requirements have pushed allowable levels of contaminants such as Sulfur in fuels (coal, diesel, gasoline, etc.) to such low levels that they are becoming difficult to measure. One previous technique, X-ray Fluorescence Spectroscopy (XRF) is capable of measuring levels as low as 10 ppm in Diesel fuel but lower levels become difficult. This difficulty is the result of getting sufficient x-ray flux from the primary excitation beam onto the target, getting the desirable energy of x-rays onto the target, and getting sufficient characteristic x-rays out of the target and into a detector.

Accordingly, an X-ray fluorescence spectrometer may be thought of as having two main component elements: 1) an X-ray generator which may emit a broad spectrum of X-rays and 2) an X-ray detector, comprising one or more optics which gather the emitted X-rays, perhaps selects rays of a desired energy spectrum and directs them through a window leading to the detector. The presently disclosed invention first relates to the X-ray generator component of the spectrometer. The invention also relates to the detector portion of the spectrometer.

Moreover, in x-ray analysis it is often desirable to produce a small spot with a high flux of nearly mono-energetic x-rays. Most current systems are inefficient at this because they collect a very small portion of the emitted x-rays. The x-ray optical system disclosed here would collect a very large solid angle of the emitted x-rays, monochromatize them and then concentrate them to a small spot.

Additionally, in X-ray micro-analysis, Wavelength Dispersive Spectroscopy (WDS) is used whenever high energy resolution or high count rates are needed for the sample being analysed. Unfortunately, many WDS systems suffer from low count rates because the diffractor collects a small solid angle of the emitted x-rays. It is sometimes possible to move the diffractor closer to collect a larger solid angle but this causes poor resolution. Sometimes, special optics can be used to collect a large solid angle but previous optics have had small collection angles for energies above 1000 eV. The x-ray optical system disclosed could be used for a new type of WDS using the unusual x-ray optics that collect a large solid angle with high efficiency.

SUMMARY OF THE INVENTION

With the foregoing in mind, the present invention advantageously provides an apparatus including optics which produce conically parallel beams of x-rays. The term "conically parallel" has been coined in the present invention to describe a beam of x-rays having the following characteristics.

A conically parallel beam is an x-ray beam having a beam axis, the beam forming a ring or portion of a ring on an image plane lying perpendicular to the beam axis, the ring or portion of the ring having an inner diameter, an outer diameter and a ring wall therebetween, the inner and outer diameters changing in dimension and the ring wall unchanging in thickness as the image plane is moved along the optical axis of the beam. As shown in the figures, an imaginary plane containing the optical axis will contain two beams, each collimated along its own beam axis but otherwise diverging or converging toward each other.

The concept of a "conically parallel" beam may be better understood by reference to FIG. 1, where diverging rays are shown to be generated from a small spot x-ray source and reflect from a surface to produce the conically parallel beam. A plane containing the optical axis will contain two parallel beams if the reflector and diverging beam are full figures of revolution.

BRIEF DESCRIPTION OF THE DRAWINGS

Some of the features, advantages, and benefits of the present invention having been stated, others will become apparent as the description proceeds when taken in conjunction with the accompanying drawings, presented solely for exemplary purposes and not with intent to limit the invention thereto, and in which.

DETAILED DESCRIPTION OF THE PREFERRED EMBODIMENT

The present invention will now be described more fully hereinafter with reference to the accompanying drawings, in which preferred embodiments of the invention are shown. Unless otherwise defined, technical and scientific terms used herein have the same meaning as commonly understood by one of ordinary skill in the art to which this invention pertains. Although methods and materials similar or equivalent to those described herein can be used in the practice or testing of the present invention, suitable methods and materials are described below. Any publications, patent applications, patents, and other references mentioned herein are incorporated by reference in their entirety. In case of conflict, the present specification, including any definitions, will control. In addition, the materials, methods and examples given are illustrative in nature only and not intended to be limiting. Accordingly, this invention may be embodied in many different forms and should not be construed as limited to the illustrated embodiments set forth herein. Rather, these illustrated embodiments are provided solely for exemplary purposes so that this disclosure will be thorough and complete, and will fully convey the scope of the invention to those skilled in the art. Other features and advantages of the invention will be apparent from the following detailed description, and from the claims.

Figure 1:
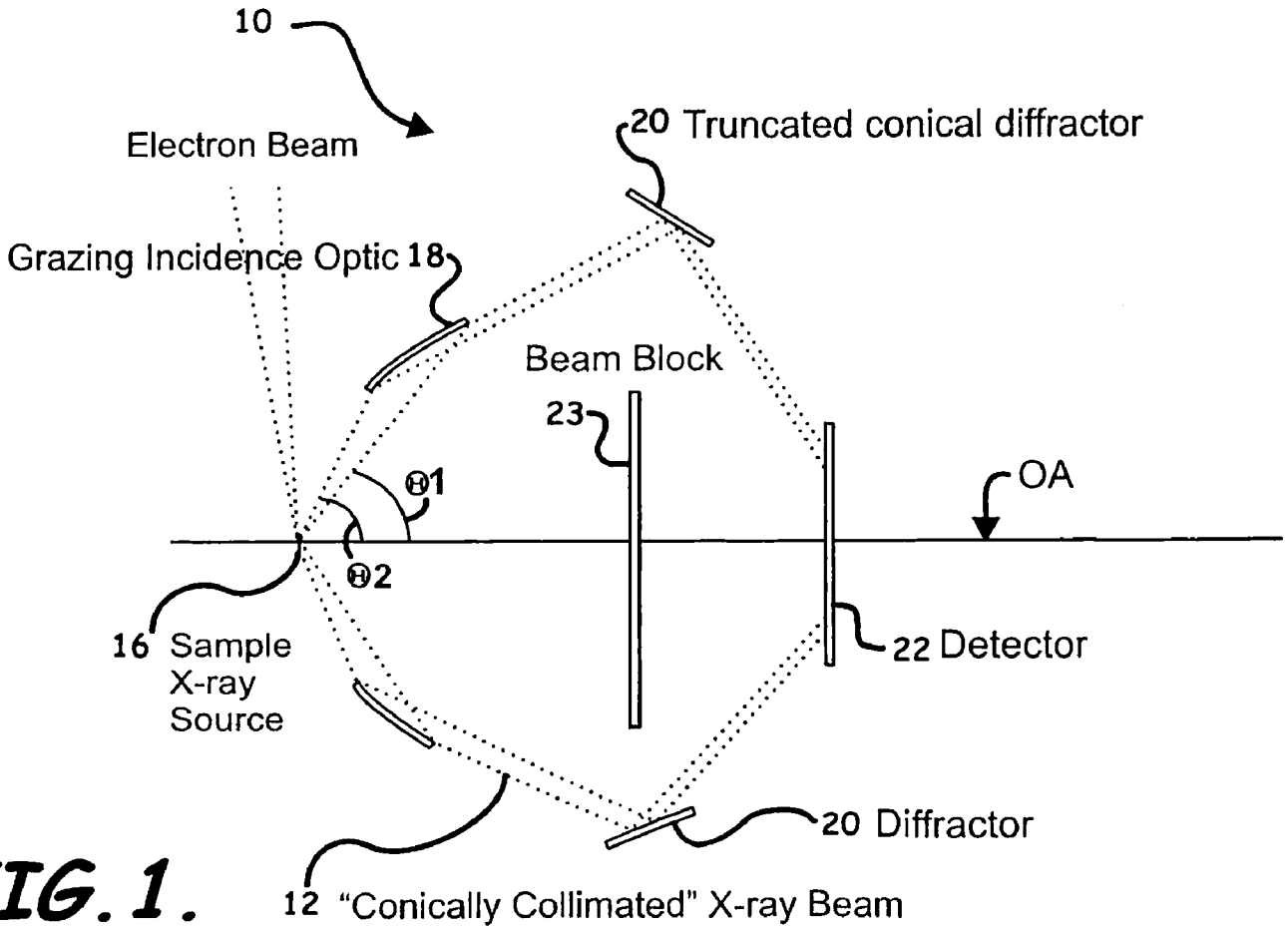
FIG. 1 is a cross sectional schematic view of an x-ray spectrometer according to an embodiment of the present invention.

FIGS. 1-5 illustrate various examples of an apparatus 10 for producing a conically parallel beam of x-rays 12 according to the present invention. As shown in FIG. 1, diverging rays 14 are generated from a small spot x-ray source 16 and reflected from an x-ray reflector 18 to produce the conically parallel beam 12. An imaginary plane (not shown, but equivalent to detector 22) containing the optical axis OA will contain two parallel beams if the reflector 18 and diverging beam are full figures of revolution, the two beams each forming half or a portion of the beam's ring wall. The optic 18 that produces the conically parallel beam collects a large solid angle because the solid angle represented by the annular ring that it collects is given by the formula:

$$SA=2\pi(\cos(\Theta_1)-\cos(\Theta_2))$$

In the formula, $\Theta_1$ and $\Theta_2$ can be large angles, as illustrated in FIG. 1, whereas a typical grazing angle $\phi$ is small for high reflectivity. By contrast, an optic with the same grazing angle $\phi$ that produces a collimated beam where all the x-rays are parallel to the optical axis would collect a much smaller solid angle than the presently disclosed apparatus.

Another way to visualize the shape of these optics is as follows. Take a slice of a parabola so that the slice contains the optical axis. This gives you an upper and lower half of the parabola. Tilt each half with respect to the optical axis by the angle $\Theta$ in FIG. 1. Then, rotate this slice about the optical axis to produce a figure of revolution. The focusing optic can be produced in the same manner, except its angle $\Theta$ might not be the same as for the first optic.

The equation of a paraboloid useful in the present invention is given in cylindrical coordinates as:

$$r=((2p(z-a))^{1/2}$$

If a linear term is added to this formula it results in the shape of an optic which produces a conically parallel x-ray beam, as follows.

$$r=((2p(z-a))^{1/2}+mz+b$$

Where a and b are constants and the inverse tangent of m is the angle $\Theta$ of FIG. 1. Additionally, it is also possible to append another figure of revolution to the entrance or exit aperture of the optic that produces conically parallel x-rays so as to collect more solid angle or to otherwise shape the beam.

Figure 2:
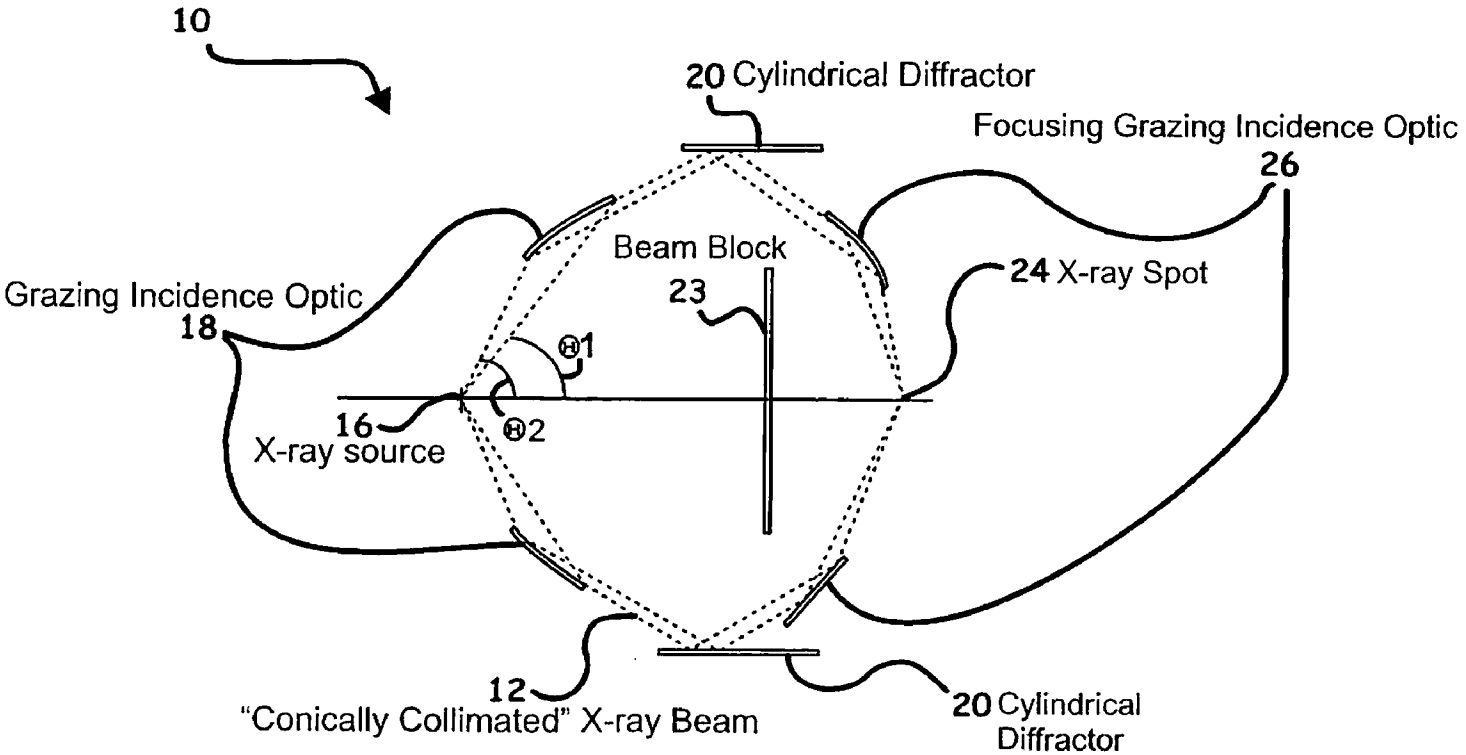
FIG. 2 shows a similar cross sectional schematic view of an apparatus for producing a small focused spot of x-rays according to another embodiment of the present invention.

As shown in FIGS. 1 and 2, the conically parallel beam is incident on a portion of a conical (FIG. 1) or cylindrical (FIG. 2) diffractor 20 where the rays diffract toward further use in the apparatus, for example, toward a detector 22. A beam block 23 is positioned to block the detector from detecting x-rays from the source other than the diffracted conically parallel beam of x-rays. It should be noted that all the rays encounter the diffractor 20 surface at the same Bragg angle so that the 2d-spacing of the diffractor can be constant along its length. If the diffractor 20 cone were slit along its length, the diffractor could be opened or closed in such a manner as to cause the cone angle to change thus changing the Bragg angle for all rays. Thus, the wavelength could be scanned by opening or closing the slit to vary the cone angle.

Figure 3:
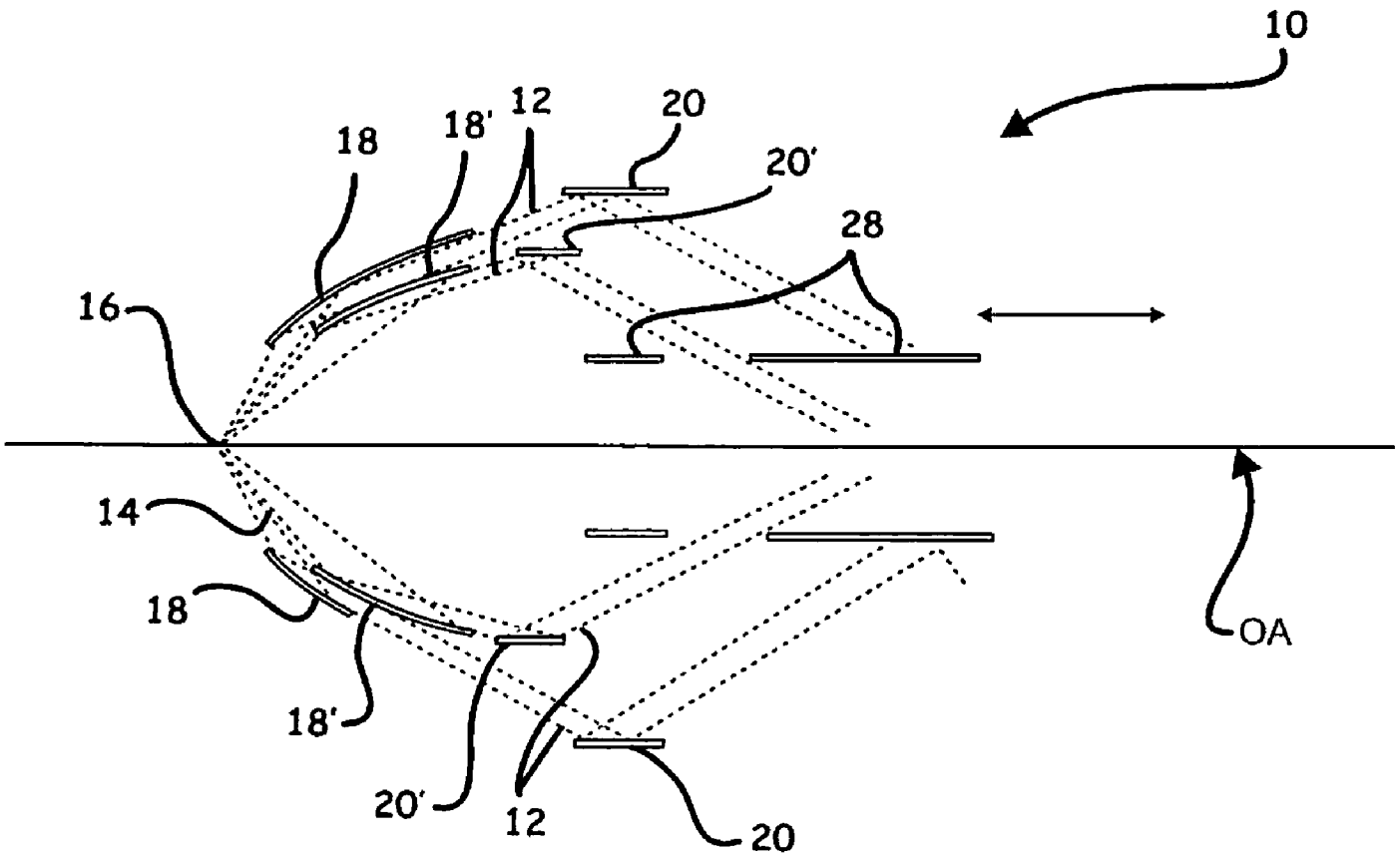
FIG. 3 illustrates, in schematic cross sectional view, an apparatus or spectrometer capable of selecting monochromatic x-rays from a polychromatic x-ray source, that is, having single or multi energy levels.

If the apparatus 10 is operated in a "fixed" wavelength mode, the cone angle need not change and the diffractor(s) 20 or diffracting surface(s) can simply be applied to suitably shaped backings. If, however, the detector 22 is capable of some energy discrimination, multiple diffractors 20 of different 2d-spacings may be employed to analyze more than one wavelength band at a time. These multiple diffractors 20 may all be portions of a single cone or portions of nested cones which see rays reflected by nested collection optics, as illustrated in FIG. 3. Alternatively, multiple detectors 22 could be used to detect the x-rays from the various diffractors 20.

When used to produce a small spot of mono-energetic x-rays, the apparatus 10 and optics would be used in the configuration shown in FIG. 2. In this embodiment of the invention, the apparatus' optics initially produce a conically parallel beam from x-rays diverging from a source. The conically parallel x-rays 12 are then monochromatized, that is, x-rays having substantially a single energy are selected by a truncated conical diffractor 20 as shown in FIG. 1, or the diffractor could also be cylindrical, as shown in FIG. 2, which diffracts them into a conically parallel beam back toward the optical axis OA. These diffracted x-rays may be then refocused by an additional focusing optic 26 similar to the optics used to produce the original conically parallel beam.

Applications of such an apparatus 10 for producing a small spot would include detection of sulfur in fuels, detection of lead using x-rays that are very efficient for such excitation. A system of this sort could also be used for small spot XPS by using an aluminum x-ray tube anode or even an aluminum/magnesium alloy. Selection of excitation by either aluminum or magnesium could be accomplished by either changing the conical diffractor or by changing its cone angle. Another potential application of such a system would be detection of specific dopants in silicon wafers by proper selection of the x-ray tube anode.

Yet another embodiment of the invention is an apparatus and method for selecting a desired x-ray line from an x-ray source anode that emits multiple lines, such as an aluminum/magnesium anode, as shown in FIG. 3. The outer optic 18 directs x-rays 14 diverging from a small source 16 to a diffractor 20 for one x-ray line while the inner nested optic(s) 18' directs x-rays 14' to a diffractor 20' for another line. The desired x-ray line can be chosen for illumination of a target or to be focused by another optic, as shown in FIG. 2, by moving the cylindrical aperture block 28 so that only the x-rays from either the outer 18 or inner 18' optic are allowed to pass. Such an arrangement would be particularly useful for XPS.

Figure 4:
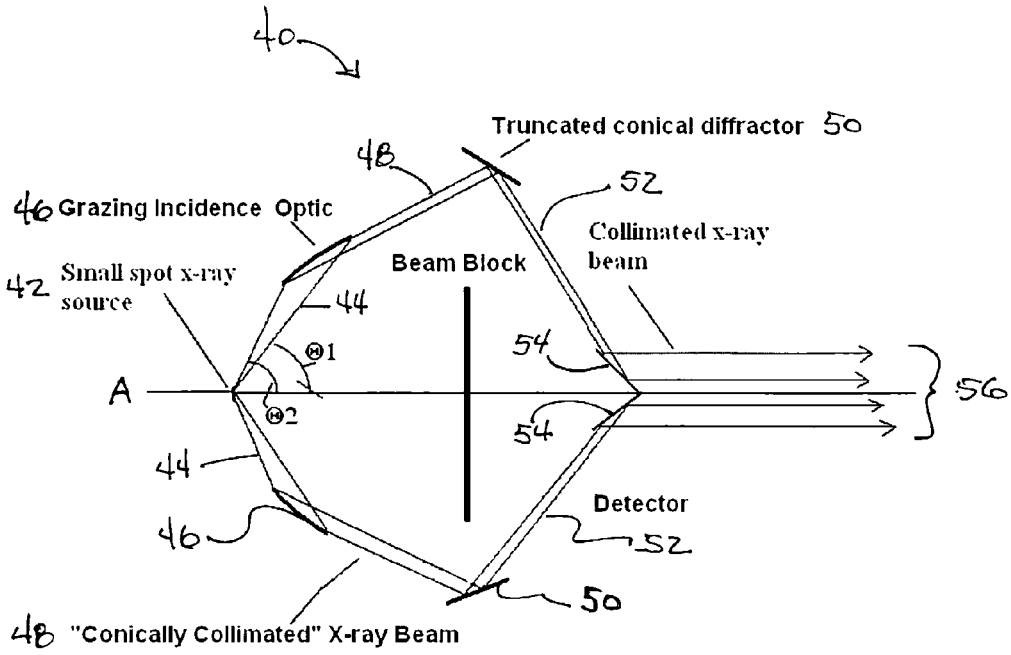
FIG. 4 shows a spectrometer of the present invention, using an optic that produces a conically parallel beam to produce a well collimated monochromatic beam which may be directed into a detector.
Figure 5:
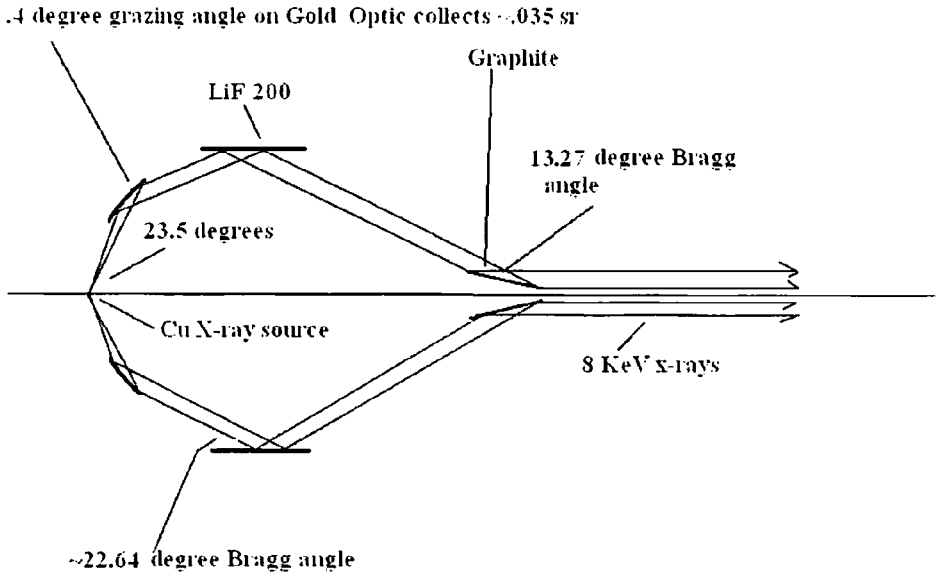
FIG. 5 shows a diagram of an optical system using the present invention in a conically parallel beam to make a very highly collimated x-ray beam in an x-ray diffractometer.

Included in the invention is an apparatus 40 and method for producing a parallel beam of monochromatic radiation, which is shown in FIG. 4. An x-ray source 42 generates x-rays 44 which then illuminate a suitable optic 46 to produce a conically parallel beam 48 that is incident on a cylindrical or conical diffractor 50. The diffracted monochromatic beam 52 is diffracted back toward the axis (A) where it encounters a second diffractor 54 that re-directs it into a collimated beam 56 of substantially parallel X-rays. This parallel beam 56 might be very small and suitable for micro-diffraction studies of materials. FIG. 5. shows a specific embodiment of the present invention for an X-ray diffractometer.

Various applications of a spectrometer using these optics include spectroscopy of x-ray or VuV produced by charged particles such as on an electron microscope or focused ion beam, x-ray or VuV spectroscopy of x-rays or VuV excited by x-ray fluorescence and x-ray or VuV spectroscopy of plasmas. Some specific applications include detection of sulfur in fuels, detection of dopants such as B or P in Si wafers, detection of thin diffusion barrier layers in semiconductor fabrication, and other applications involving closely spaced x-ray spectral lines. As shown in FIG. 5. such optics are useful for x-ray diffractometry.

There are various options for the conical or cylindrical diffractor including synthetic multilayer diffractors, crystalline materials, diffraction gratings or Langmuir-Blodgett films. For multilayer diffractors, the multilayer could be applied to a very thin substrate such as ultra-thin silicon wafers, thin mica or very thin glass. The substrate must be thin enough that it can bend to the desired radius of curvature.

Some crystal diffractors are suitable for bending to small radii of curvature and there are crystals of sufficient different d-spacings to enable the method to be used over the entire x-ray spectrum from 100 eV up to over 15 KeV. HOPG (Highly Oriented Pyrolytic Graphite) is particularly useful because it has a very high diffracted intensity and can be applied to highly curved backings. It can also be made with different ranges of crystal "mosaicity" so that the angular width of its diffraction peak can be either broad or narrow. A wide diffraction peak such as produced by ZYC grade HOPG would be useful for x-ray sources that are "extended" sources because they will not be truly collimated when they reach the diffractor and will diffract more such x-rays than a narrow diffraction peak. A Narrow peak such as from grade ZYA HOPG would be useful when analyzing signals coming from a sample because this results in better energy resolution. Such a spectrometer system could use various detector systems including proportional counters, electron multiplier detectors and silicon drift detectors.

Those skilled in the art will recognize that the present disclosure is intended to include the optic which produces the conically parallel beam of x-rays. This inventive x-ray optic has an x-ray grazing incidence reflecting surface along a full figure of revolution geometry and is effective for collecting a solid angle of x-rays diverging from a source, the solid angle defined by the formula $2\pi(\cos(\Theta_1)-\cos(\Theta_2))$ so as to thereby collimate the x-rays into a conically parallel beam.

Additionally, the skilled will also appreciate that a conically parallel beam of x-rays is a product in itself. Thus, the present invention includes a conically parallel beam consisting of an x-ray beam having a beam axis, the beam consisting of collimated parallel x-rays forming a ring or portion of a ring on an image plane lying perpendicular to the beam axis, the ring or portion of the ring having an inner diameter, an outer diameter and a ring wall therebetween, the ring wall consisting of substantially parallel x-rays, the inner and outer diameters changing in dimension and the ring wall unchanging in thickness as the image plane is moved along the optical axis of the beam. Accordingly, in its broad concept, the present invention is intended to include any X-ray apparatus which includes and/or relies on a conically parallel beam of X-rays.

As the skilled will recognize, the present invention also provides a variation on the use of Wavelength Dispersive X-ray Spectroscopy which achieves considerably lower detection limits than existing systems for such contaminants in fuels. This new system uses a combination of unusual x-ray optics and x-ray source to achieve this end. In addition to detection of Sulfur in fuels, a similar system could be used for detection of Pb, or Bi in materials.

The present system uses an optic having either a single truncated diffracting ring or multiply nested diffracting rings arranged so as to collect characteristic x-rays emitted from a source and to concentrate them to a small spot on the sample being tested. The rings 13 and 14 as shown in FIG. 1 are arranged so as to be a portion of a truncated cone so that x-rays encounter the rings at angles close to the Bragg angle for diffraction. A diffracting material for the ring is chosen for its Bragg angle, its diffraction efficiency, and the capability to bend it into the desired ring. These materials include Highly Oriented Pyrolytic Graphite (HOPG), Mica, Ge, LiF, or PET. HOPG is desirable because some grades have a very broad rocking curve so that we can arrange for a large solid angle of emitted x-rays to be diffracted with high efficiency. Other diffracting rings can be placed inside the outermost one with a different cone angle that obeys the Bragg relation for diffraction and diffracts the x-rays onto the same area as the outermost ring.

For the detector, I propose a novel type of wavelength dispersive spectrometer (WDS) that collects a greater solid angle than most other types. This spectrometer uses an unusual type of grazing incidence reflector that collects a large solid angle of x-rays emanating from the small spot on the sample and reflects them into a conically parallel beam, as illustrated in FIG. 2. Multiple reflectors of this type can be nested so as to collect an even larger solid angle. The "conically parallel" (CP) x-rays 24 are incident on single or multiply nested truncated diffracting cones 25 arranged to be at the correct angle for Bragg diffraction. X-rays 26 diffracted from these conical surfaces pass into an x-ray counter such as a large window 27 proportional counter, an electron multiplier, a drift detector or a large PIN diode detector.

Dispersion of the x-rays can be accomplished by changing the diffracting cone angle by having a lengthwise slit in the cone that can be opened and closed in a way that varies the cone angle. Suggested diffracting materials are HOPG, LiF, PET, TAP, Mica, Ge and multilayers deposited onto flexible substrates.

Accordingly, in the drawings and specification there have been disclosed typical preferred embodiments of the invention and, although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as recited in the appended claims.

What is claimed is:

1. An apparatus directing x-rays along a predetermined axis, said apparatus comprising:

an x-ray optic having one or more nested x-ray reflector rings positioned relative to a source generating broad spectrum x-rays so that generated x-rays moving away from the predetermined axis are collected by said reflector incident at or close to a Bragg angle to thereby reflect the collected x-rays into a conically parallel beam;

a first diffractor positioned relative to said x-ray optic to receive incident thereon the conically parallel beam, said first diffractor selected from a truncated cone and a cylinder and diffracting the conically parallel beam toward the predetermined axis; and a second diffractor positioned relative to said first diffractor and having a geometry effective to receive incident thereon and redirect the conically parallel beam along the predetermined axis as a collimated beam of substantially parallel x-rays.

2. The apparatus of claim 1, wherein a target lies along the predetermined axis so as to thereon receive the collimated beam of substantially parallel x-rays.

3. The apparatus of claim 1, further comprising a beam block positioned to prevent x-rays from the source other than the diffracted conically parallel beam of x-rays from reaching said second diffractor.

4. The apparatus of claim 1, wherein said x-ray optic has an x-ray grazing incidence reflecting surface along a full figure of revolution geometry effective for collecting a solid angle of x-rays diverging from said source and the solid angle is defined by the formula $2\pi(\cos(\Theta_1)-\cos(\Theta_2))$ so as to collimate the collected x-rays into a conically parallel beam of x-rays.

5. The apparatus of claim 1, wherein said first diffractor comprises a truncated cone having an x-ray diffracting surface along an interior of the cone, the truncated cone optionally having a slit along a full lengthwise dimension.

6. The apparatus of claim 1, wherein said second diffractor comprises a truncated cone having an x-ray diffractive surface along an exterior surface of said truncated cone.

* * * * *